US009248357B2

(12) United States Patent
Francis

(10) Patent No.: US 9,248,357 B2
(45) Date of Patent: Feb. 2, 2016

(54) BEAN BAG TOSSING GAME

(71) Applicant: Bradley David Francis, Cary, NC (US)

(72) Inventor: Bradley David Francis, Cary, NC (US)

( * ) Notice: Subject to any disclaimer, the term of this patent is extended or adjusted under 35 U.S.C. 154(b) by 135 days.

(21) Appl. No.: 13/927,967

(22) Filed: Jun. 26, 2013

(65) Prior Publication Data

US 2014/0015198 A1 Jan. 16, 2014

Related U.S. Application Data

(60) Provisional application No. 61/665,164, filed on Jun. 27, 2012.

(51) Int. Cl.

| | |
|---|---|
| ***A63B 67/06*** | (2006.01) |
| ***A63B 63/08*** | (2006.01) |
| ***A63B 63/00*** | (2006.01) |

(52) U.S. Cl.

CPC ..... *A63B 63/00* (2013.01); *A63B 67/06* (2013.01); *A63B 63/08* (2013.01); *A63B 2067/061* (2013.01)

(58) Field of Classification Search

CPC ..... A63B 67/06; A63B 63/00; A63B 63/08

USPC ..... 273/398, 402, 342, 352, 400

See application file for complete search history.

(56) References Cited

U.S. PATENT DOCUMENTS

| | | | | |
|---|---|---|---|---|
| 1,834,317 | A * | 12/1931 | Peccerillo | A63F 9/02 273/352 |
| 1,979,584 | A * | 11/1934 | Thompson | A63B 67/02 273/398 |
| 2,155,929 | A * | 4/1939 | Breitenstein | A63B 63/00 235/144 SP |
| 4,938,485 | A * | 7/1990 | Hockridge | A63F 9/02 273/354 |
| 5,123,656 | A | 6/1992 | Green | |
| 2010/0164175 | A1 | 7/2010 | Buchanan | |
| 2010/0320692 | A1 | 12/2010 | Tookey | |

* cited by examiner

*Primary Examiner* — Gene Kim
*Assistant Examiner* — Jeffrey Vanderveen

(57) ABSTRACT

An adapter for modifying a cornhole platform. The adapter may include an insert that may fit within the opening of the cornhole platform. Attached to the insert may be at least one barrier including sidewalls that may rest on the surface of the cornhole platform when the insert is within the opening. The barrier may include multiple rings attached to the insert.

5 Claims, 4 Drawing Sheets

BEAN BAG TOSSING GAME

BACKGROUND OF THE INVENTION

The present invention relates to a bean bag tossing game and, more particularly, to an adapter for a bean bag tossing game.

Cornhole, also known as bean bag toss, corn toss, baggo or bags, is a lawn game in which players take turns throwing bags of corn at a raised platform with a hole in the far end. However, playing cornhole for extended periods of time may become repetitive. Therefore, more games may be needed to stay entertained which may require carrying extra equipment.

As can be seen, there is a need for an adapter to easily change a first game to a second game.

SUMMARY OF THE INVENTION

In one aspect of the present invention, a bean bag toss game adapter comprises: an insert having a rounded shape, wherein the insert comprises an open top end and a bottom end, wherein the bottom end is configured to rest within a cornhole board opening; and a least one barrier comprising at least one sidewall having a top edge and a bottom edge, wherein the barrier is attached to the insert and wherein the bottom edge of the barrier is formed to rest on a top side of the cornhole board when the bottom end of the insert is resting within the cornhole board opening and thereby creating a new scoring section on the cornhole board.

In another aspect of the present invention, a bean bag toss game comprises: a substantially flat game board having a top side, a bottom side, a front end, and a rear end, wherein the game board comprises an opening through the top side and bottom side near the rear end; at least one support leg adjacent to the rear end and the bottom side of the platform, wherein the support leg supports the rear end; an insert having a circular shape, wherein the insert comprises an open top end and a bottom end, wherein the bottom end is within the opening of the game board; and a least one barrier comprising at least one sidewall, wherein the barrier rests on the top side of the game board.

These and other features, aspects and advantages of the present invention will become better understood with reference to the following drawings, description and claims.

DETAILED DESCRIPTION OF THE INVENTION

Figure 1:
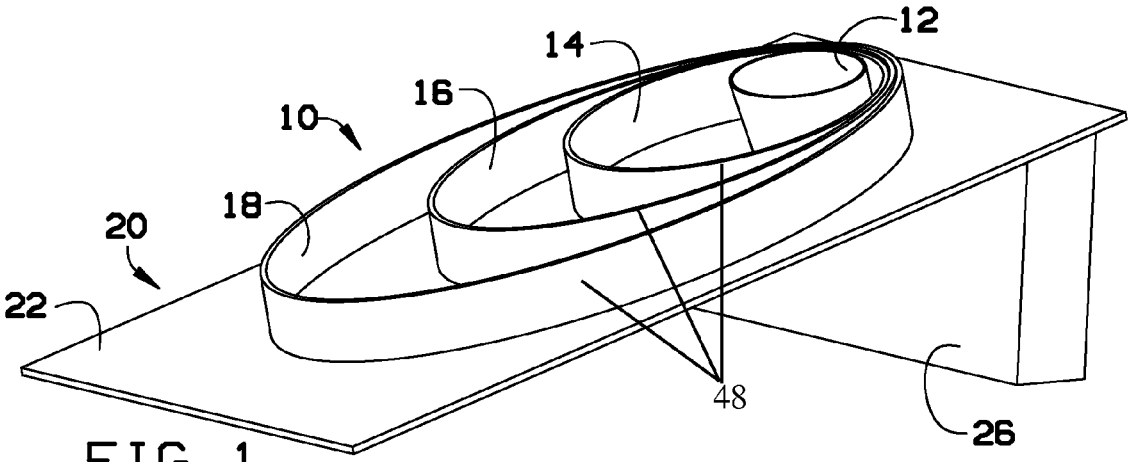
FIG. 1 is a perspective view of the present invention.
Figure 2:
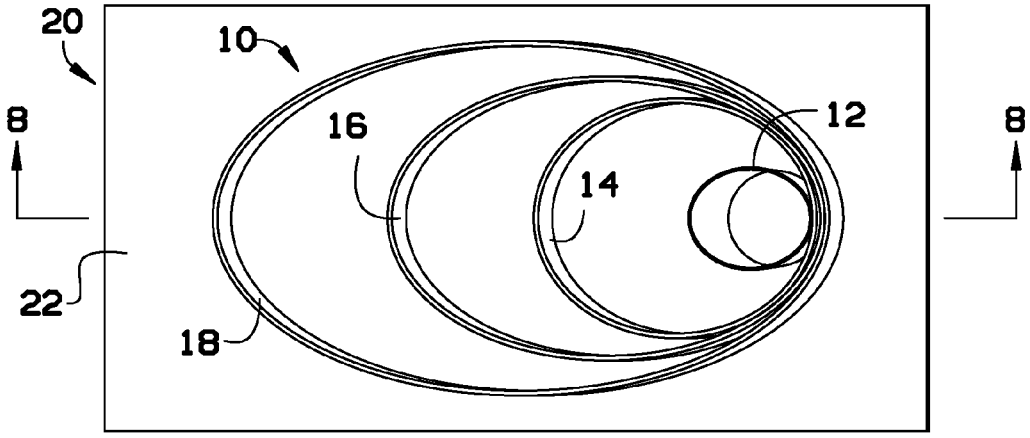
FIG. 2 is a top view of the present invention.
Figure 3:
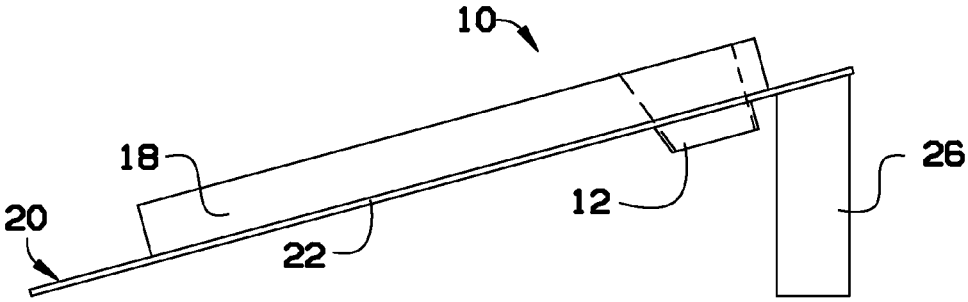
FIG. 3 is a side view of the present invention.
Figure 4:
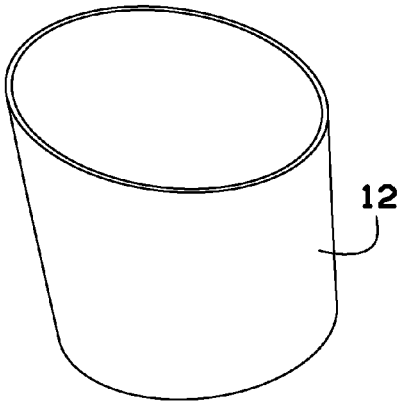
FIG. 4 is a perspective view of the insert of the present invention from FIG. 1.
Figure 5:
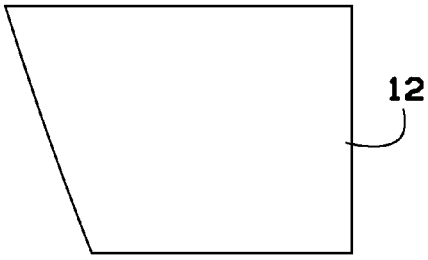
FIG. 5 is a side view of the insert of the present invention from FIG. 1.
Figure 6:
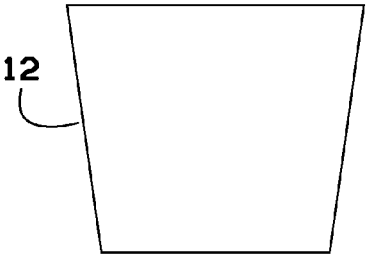
FIG. 6 is a front view of the insert of the present invention from FIG. 1.
Figure 7:
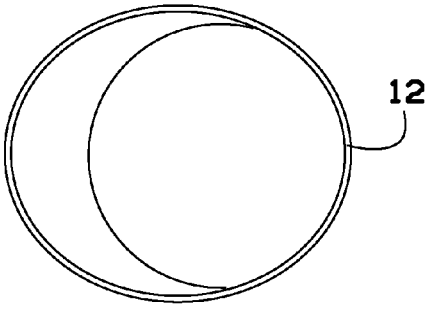
FIG. 7 is a top view of the insert of the present invention from FIG. 1.
Figure 8:
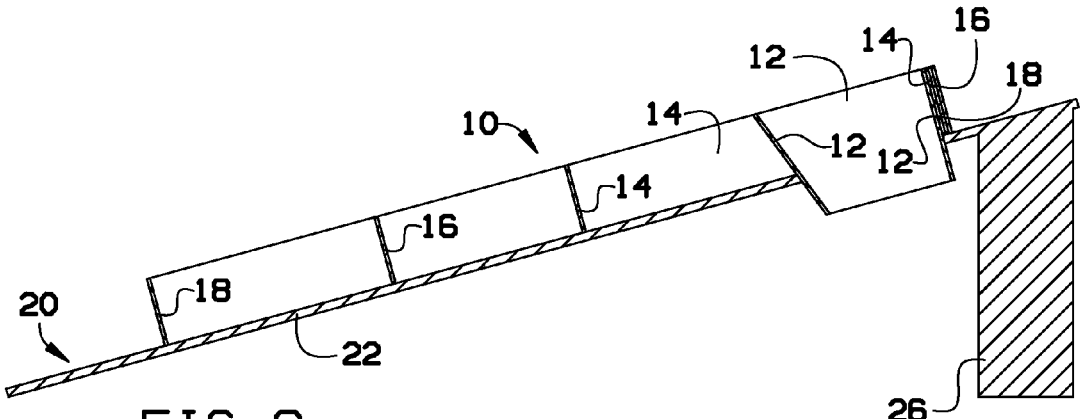
FIG. 8 is a section view of the present invention along line 8-8 in FIG. 2.
Figure 9:
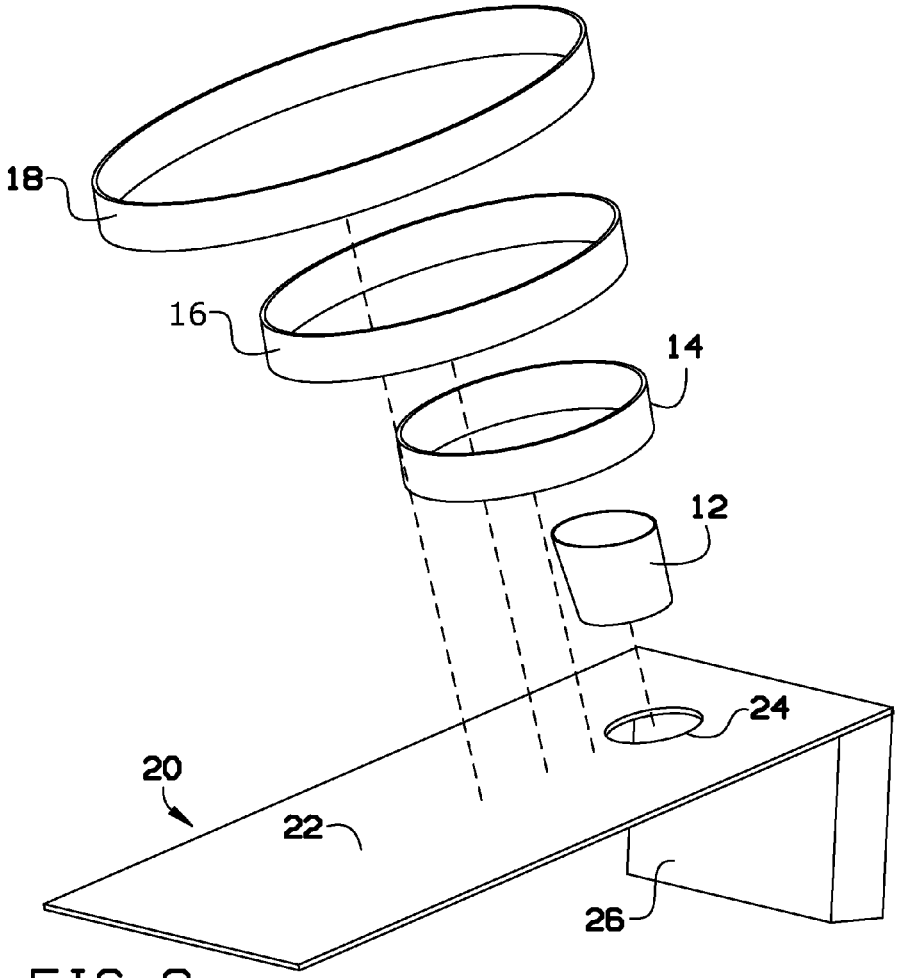
FIG. 9 is an exploded view of the present invention.
Figure 10:
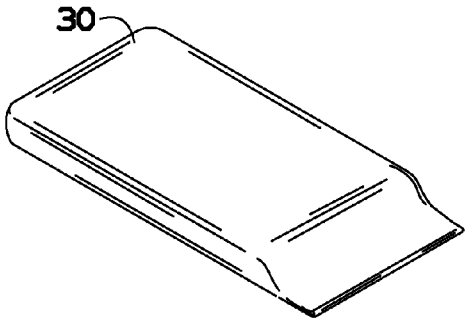
FIG. 10 is a perspective view of a standard bean bag only.
Figure 11:
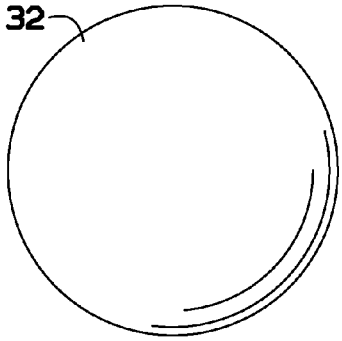
FIG. 11 is a perspective view of a bean bag ball only.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an adapter for modifying a cornhole platform. The adapter may include an insert that may fit within the opening of the cornhole platform. Attached to the insert may be at least one barrier including sidewalls that may rest on the surface of the cornhole platform when the insert is within the opening. The barriers may include multiple rings attached to the insert.

In certain embodiments, the present invention may be a bean bag tossing game and in certain embodiments may be an adapter for cornhole. The present invention may provide an adapter for an entertaining alternative while using the same basic components as traditional cornhole. The adapter, which may include a series of connected oblong target rings, may be inserted into the target opening of the original game cornhole platforms and thus converting the platform to a new tossing game, without altering any aspect of the original platform.

Referring to FIGS. 1 through 15, the present invention may include a game adapter 10 for a bean bag toss game, such as cornhole. The game adapter 10 may include an insert 12. The insert 12 may have a rounded shape similar to a tube, with an open top end and an open bottom end. The rounded shape may conform to the opening 24 in a game platform 20 of a cornhole board. The bottom of the insert 12 may be configured to fit and rest within the opening 24 of the game platform 20. In certain embodiments, the insert 12 may be a target ring. The target ring may be tapered from the top end to the bottom end so that the insert 12 may fit within any sized opening 24 of a cornhole game platform 20.

In certain embodiments, the present invention may include at least one barrier 48. The barrier 48 may include at least one side wall having a top edge and a bottom edge. The barrier 48 may be attached to the insert 12. The bottom edge may be formed to rest on the top side 22 of the game platform 20 when the bottom end of the insert 12 is resting within the game platform opening 24. The barrier 48 thereby creates a new scoring section on the game platform 20.

Figure 13:
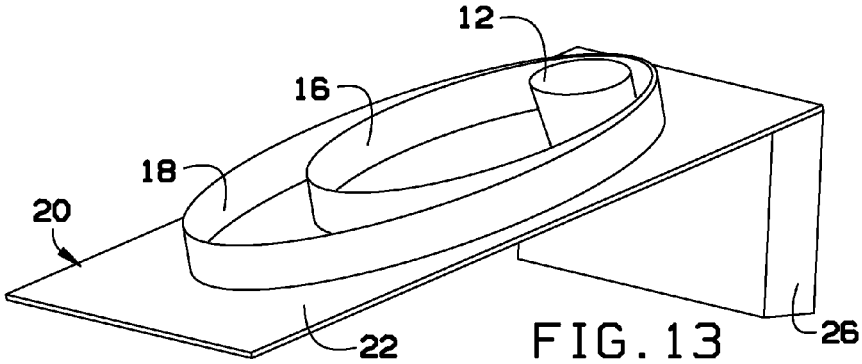
FIG. 13 is a perspective view of an alternate embodiment of the present invention.
Figure 14:
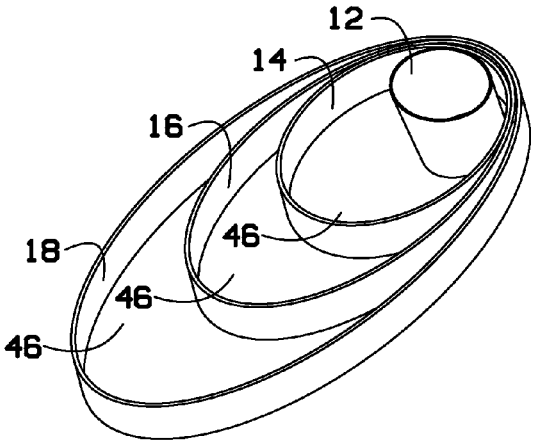
FIG. 14 is a perspective view of an alternate embodiment of the present invention.
Figure 15:
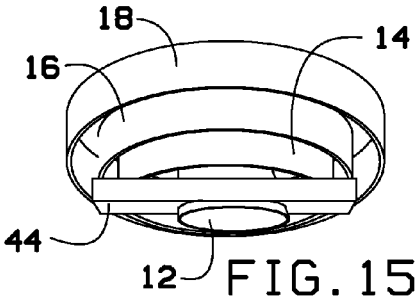
FIG. 15 is a back view of an alternate embodiment of the present invention.

The barrier 48 may have an oval shape. However, it is envisioned that the barrier 48 may be of any shape as long as the shape facilitates a new scoring section on the cornhole game platform 20. In certain embodiments, the barrier 48 may include multiple sections to create multiple scoring sections. For example, the barrier 48 may include a first ring 14 and a second ring 16 surrounding the first ring 14 as illustrated in FIG. 13. In certain embodiments, the present invention may further include a third ring 18 surrounding the second ring 16 to create another scoring section on the game platform 20.

The game adapter 10 may be connected to the game platform 20 by inserting the extension of the bottom end of the insert 12 into the opening 24. The game adapter 10 may be constructed through joining the insert 12, the first ring 14, the second ring 16 and a third ring 18 as a single unit attached at a common point at the upper side of the insert 12 and each ring 14, 16, 18. For purpose of play, bean bags 30 or bean balls 32 may be tossed in an underhand fashion toward the game adapter 10 that is connected to the game platform 20.

In certain embodiments, the adapter 10 may be used as a stand-alone unit. For example, the adapter 10 may further include a stabilizing bar 44 and/or a solid base 46 within the rings 14, 16, 18. The stabilizing bar 44 may be attached to the bottom end of the insert and the bottom edge of the at least one barrier 48. The stabilizing bar 44 may support the adapter 10 and thereby prop up the adapter 10. Therefore, the game adapter 10 may be used without the cornhole game platform 20.

In certain embodiments, the insert 12 and the at least one barrier 48 may be directly connected to a game platform 20. Therefore, the present invention may include a bean bag toss game that includes a substantially flat game board 20 having a top side 22, a bottom side, a front end, and a rear end. The game board 20 may include an opening 24 through the top side 20 and bottom side near the rear end. At least one support leg 26 may be adjacent to the rear end and the bottom side of the platform 20. The support leg 26 may support the rear end and the front end may rest on a surface. Therefore, the platform 20 may be propped up an angle relative to the surface. The platform 20 may further include an insert 12 having a circular shape, and having an open top end and a bottom end. The bottom end may be within the opening 24 of the game platform 20. The game platform 20 may further include at least one barrier 48 which may include at least one sidewall. The barrier 48 may be attached to the insert and rest on the top side 22 of the game platform 20.

Several potential variations of the construction and/or use of the bean bag tossing game are disclosed: dimensions of the game adapter 10 may be altered for use on various sizes of bean bag tossing game platforms 20; the game adapter 10 may be constructed in a manner to allow more or less rings to be leveraged on the target platform 20; the shape of the rings may be altered to adjust to the shape of the target board platform 20 including rectangular, circular, and the like; the shape and dimensions of the insert 12 may be modified to provide more flexibility to adjust to varied size target openings 24 on the game platforms 20; the insert 12 may be designed to be compressible for packing or transportation purposes; rules of play for the adapted game may be adjusted so as to not be the same as the standard bean bag tossing game; a floatable game adapter 10 made of open cell material that may float in water and thereby enabling use in swimming pools and the like; and the present invention may further include a solid base 46 so that the game adapter 10 may be used by itself. The game adapter 10 may be further placed vertically and leveraged as a target for throwing, tossing, or shooting. For example, the present invention may be used as a training aid for pitching baseballs at the target.

Figure 12:
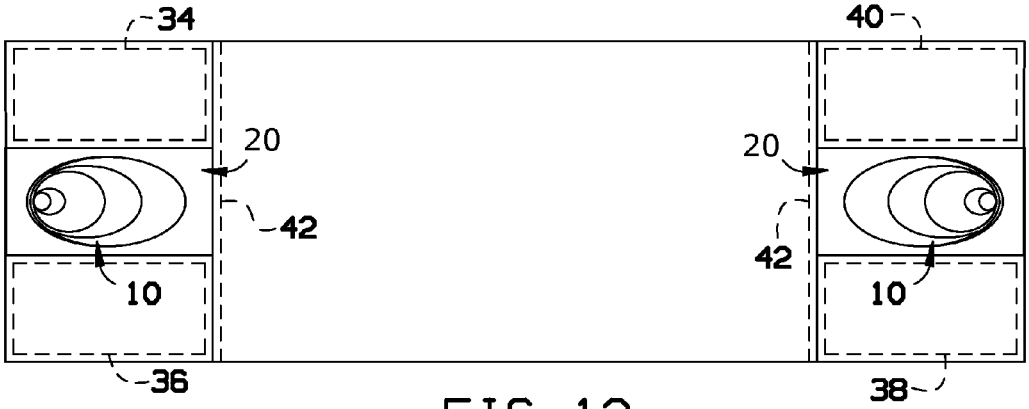
FIG. 12 is a top schematic view of exemplary court layout.

As illustrated in FIG. 12, two game platforms 20 with the attached game adapters 10 may be placed approximately twenty-seven feet apart as measured from the front edge of the facing platforms. There may be a team A and a team B, with a team A left tossing area 34, a team A right tossing area 40, a team B right tossing area 36, and a team B left tossing area 38. Players alternate pitching bean bags 30 in an underhand motion in the direction of the opposite target platform 20 until each player has tossed all four of their identified bean bags 30. During the tossing process a player's foot may not cross the foul line 42 (front edge of target platform) prior to the landing of the bean bag 30.

Scoring approaches may vary. An example of the scoring of the present invention may include the following: landing a bean bag 30 within the third ring 18 may be one point, within the second ring 16 may be two points, within the first ring may be three points, and within the insert 12 may be five points. Any bean bag 30 that is not fully within a given ring may not be awarded points. The scoring approach may include a cancellation scoring such that the points of one player cancel out the points of their opponent, resulting in a single net score. Only one player or team can score in each round of tossing a combined eight bean bags 30. Games may be typically played to a total of twenty-one points.

The game adapter 10 of the present invention may be made as a one-piece construction using either a plastic thermoforming or injection molding process.

It should be understood, of course, that the foregoing relates to exemplary embodiments of the invention and that modifications may be made without departing from the spirit and scope of the invention as set forth in the following claims.

What is claimed is:

1. A bean bag toss game adapter comprising:

an insert comprising a tubular shape having an open top end and an open bottom end, wherein the open bottom end is configured to rest within a cornhole board opening; and a first ring and a second ring each comprising a sidewall having an oval shape, wherein the sidewall comprises an upper edge and a lower edge, wherein the second ring surrounds the first ring and the first ring surrounds the insert, wherein the sidewall of the first ring, the sidewall of the second ring and the insert are connected together at a common point at an upper side of each of the insert, the first ring, and the second ring, wherein the open bottom end of the insert is protruding beyond the lower edge of the sidewall of the first ring and the second ring.

2. The bean bag toss game adapter of claim 1, further comprising a third ring surrounding the second ring.

3. The bean bag toss game adapter of claim 1, wherein the insert is a game ring tapering from the open top end to the open bottom end.

4. The bean bag toss game adapter of claim 1, further comprising a stabilizing bar attached to the bottom end of the insert and the bottom edge of the at least one barrier.

5. The bean bag toss game adapter of claim 1, wherein the adapter is formed of an open cell material and thereby floatable in water.

* * * * *